US006340010B1

(12) United States Patent
Hara et al.

(10) Patent No.: US 6,340,010 B1
(45) Date of Patent: Jan. 22, 2002

(54) VALVE OPERATING DEVICE FOR INTERNAL COMBUSTION ENGINE WITH VARIABLE VALVE TIMING AND VALVE-LIFT CHARACTERISTIC MECHANISM

(75) Inventors: Seinosuke Hara; Makoto Nakamura; Yoshihiko Yamada, all of Kanagawa (JP)

(73) Assignee: Unisia Jecs Corporation, Atsugi (JP)

( * ) Notice: Subject to any disclaimer, the term of this patent is extended or adjusted under 35 U.S.C. 154(b) by 0 days.

(21) Appl. No.: 09/611,559

(22) Filed: Jul. 7, 2000

(30) Foreign Application Priority Data

Jul. 8, 1999 (JP) ..... 11-193820

(51) Int. Cl.[7] ..... F01L 13/00

(52) U.S. Cl. ..... 123/90.16; 123/90.39

(58) Field of Search ..... 123/90.15, 90.16, 123/90.17, 90.22, 90.39, 90.44

(56) References Cited

U.S. PATENT DOCUMENTS 5,203,289 A * 4/1993 Hara et al. ..... 123/90.16
5,445,116 A * 8/1995 Hara ..... 123/90.16
5,622,145 A * 4/1997 Hara ..... 123/90.16
5,794,576 A * 8/1998 Hara et al. ..... 123/90.16

* cited by examiner

*Primary Examiner*—Weilun Lo
(74) *Attorney, Agent, or Firm*—Foley & Lardner

(57) ABSTRACT

A valve operating device for an engine having at least two engine valves per cylinder, the valve operating device enabling both valve timing and valve-lift characteristic to be varied depending on engine operating conditions, includes a camshaft, at least one cam pair including a low-speed cam and a high-speed cam, each operating an associated valve of at least two engine valves included in a cylinder, a main rocker shaft supported on a cylinder head, a sub rocker shaft, and at least one rocker arm set. The rocker arm set includes a low-speed rocker arm having a first follower driven by the low-speed cam and oscillatingly supported by the main rocker shaft and mounting thereon the sub rocker shaft, and a high-speed rocker arm having a second follower driven by the high-speed cam oscillatingly supported by the sub rocker shaft. The second follower is closely juxtaposed to the first follower and located within a dead space defined in the outside of the engine valves included in the engine cylinder. The at least one rocker arm set includes two adjacent rocker arm sets disposed between the associated two cylinders adjoining to each other. One of the adjacent rocker arm sets has a symmetric shape with respect to the other. The low-speed rocker arm included in the one rocker arm set and the low-speed rocker arm included in the other rocker arm set are supported on the same divided rocker shaft member.

26 Claims, 6 Drawing Sheets

VALVE OPERATING DEVICE FOR INTERNAL COMBUSTION ENGINE WITH VARIABLE VALVE TIMING AND VALVE-LIFT CHARACTERISTIC MECHANISM

BACKGROUND OF THE INVENTION

1. Field of the Invention

The present invention relates to a valve operating device for an internal combustion engine equipped with a variable valve timing and valve-lift characteristic mechanism, and in particular being capable of changing both valve timing and valve-lift characteristic (lifted period and valve lift) of intake and/or exhaust valves depending on engine operating conditions.

2. Description of the Prior Art

In recent years, there have been proposed and developed various internal combustion engines equipped with a valve operating device enabling valve timing and valve-lift characteristic (lifted period and valve lift) to be varied depending on engine operating conditions, in order to reconcile both improved fuel economy during operation at low and middle engine speeds and enhanced engine output torque during operation at high engine speeds. One such valve operating device with variable valve timing and valve-lift characteristic mechanism has been disclosed in Japanese Patent Provisional Publication No. 7-279629. The valve operating device disclosed in the Japanese Patent Provisional Publication No. 7-279629 includes a camshaft driven by an engine crankshaft, a pair of low-speed and high-speed cams fixedly connected onto the camshaft in a manner so as to open two intake-port valves arranged in each individual engine cylinder, and first and second valve lifters slidably provided in respective lifter guide holes bored in an engine cylinder head for transmitting a cam lift of the selected one of the low-speed and high-speed cams to the intake-port valves. A substantially flat slider is also disposed between the low-speed/high-speed cam set and the first/second valve lifter set in such a manner as to be moveable in the axial direction of the camshaft. The slider has a plurality of cam followers on its upper surface. A switching means is provided to selectively switch the contact-position relationship between the cam followers and cams by virtue of the sliding movement of the above-mentioned slider, based on engine operating conditions. In detail, when the engine is operated in a low- or mid-speed range, the slider itself is slid in one axial direction of the camshaft so that the upper face of the first follower is brought into abutted-contact with the outer peripheral surface of the low-speed cam, and so that the first and second valve lifters are moved up and down together with the slider in accordance with the cam profile of the low-speed cam. This provides a comparatively small valve-lift characteristic (or a relatively small lifted period and valve lift) in the low- or middle-speed range. Conversely, when the engine is operated in a high-speed range, the slider is slid in the opposite axial direction of the camshaft so that the upper face of the first and second followers are brought into abutted-contact with the outer peripheral surface of the high-speed cam, and so that the first and second valve lifters are moved up and down together with the slider in accordance with the cam profile of the high-speed cam. This provides a comparatively large valve-lift characteristic (or a relatively large lifted period and valve lift). Thus, the conventional valve operating device can variably change valve timing as well as valve-lift characteristics (lifted period and valve lift) depending on engine operating conditions. Additionally, the conventional valve operating device as disclosed in the Japanese Patent Provisional Publication No. 7-279629 has various merits, for example, a compact and simple structure of the upside of the respective valve lifter, and enhanced layout flexibility in the engine room (owing to the valve operating device totally small-sized as a result of the use of the flat slider formed on its upper face with a plurality of followers).

SUMMARY OF THE INVENTION

In the conventional valve operating device which uses a flat slider with a plurality of follower portions to enable both valve timing and valve-lift characteristic to be varied, however, there is the following drawbacks.

Each of the follower portions with which the outer peripheral surface of each of the cams can be brought into abutted contact, is formed on the upper face of the slider in a manner so as to project from the slider upper face. Owing to a limited height of the valve system within a limited space in the internal combustion engine, as a matter of course, the projected amount of each of the follower portions is also limited. As a result of this, it is impossible to provide an adequate valvelift difference between a valve lift created by the low-speed cam and a valve lift created by the high-speed cam. This lowers a design flexibility of the engine. Due to the inadequate valve-lift difference, it is difficult to provide a satisfactory engine performance all over the engine operating range.

Accordingly, it is an object of the invention to provide a valve operating device for an internal combustion engine with a variable valve timing and valve-lift characteristic mechanism, which avoids the aforementioned disadvantages of the prior art.

In order to accomplish the aforementioned and other objects of the present invention, a valve operating device for an internal combustion engine having at least two engine valves per cylinder, the valve operating device enabling both valve timing and valve-lift characteristic to be varied depending on engine operating conditions, comprises a camshaft adapted to be driven by a crankshaft, at least one cam pair including a low-speed cam and a high-speed cam, each operating an associated valve of at least two engine valves included in a cylinder, and integrally formed on an outer periphery of the camshaft, a main rocker shaft supported on a cylinder head, a sub rocker shaft, at least one rocker arm set including a low-speed rocker arm having a first follower driven by the low-speed cam for operating the associated valve during a low-speed cam operating mode and oscillatingly supported by the main rocker shaft and mounting thereon the sub rocker shaft, and a high-speed rocker arm having a second follower driven by the high-speed cam for operating the associated valve during a high-speed cam operating mode and oscillatingly supported by the sub rocker shaft, the second follower of the high-speed rocker arm being closely juxtaposed to the first follower and located within a dead space defined in an outside of the at least two engine valves included in the engine cylinder, and a mode switching device provided for switching from one of the low-speed and high-speed cam operating modes to the other depending on the engine operating conditions, the mode switching device initiating the low-speed cam operating mode by disconnecting the low-speed rocker arm from the high-speed rocker arm, and initiating the high-speed cam operating mode by connecting the low-speed rocker arm to the high-speed rocker arm. It is preferable that the main rocker shaft comprises a plurality of divided rocker shaft members supported on the cylinder head and including relatively short endmost rocker shaft members respectively located closer to both ends of the engine and relatively long intermediate-divided rocker shaft members each being disposed between associated two cylinders adjoining to each other, and each of the plurality of divided rocker shaft members oscillatingly supports the low-speed rocker arm of the rocker arm set. More preferably, the at least one rocker arm set may comprise two adjacent rocker arm sets disposed between the associated two cylinders adjoining to each other, one of the two adjacent rocker arm sets has a symmetric shape with respect to the other, and the low-speed rocker arm included in the one rocker arm set and the low-speed rocker arm included in the other rocker arm set are oscillatingly supported on the same one of the relatively long intermediate divided rocker shaft members.

DESCRIPTION OF THE PREFERRED EMBODIMENTS

Figure 1:
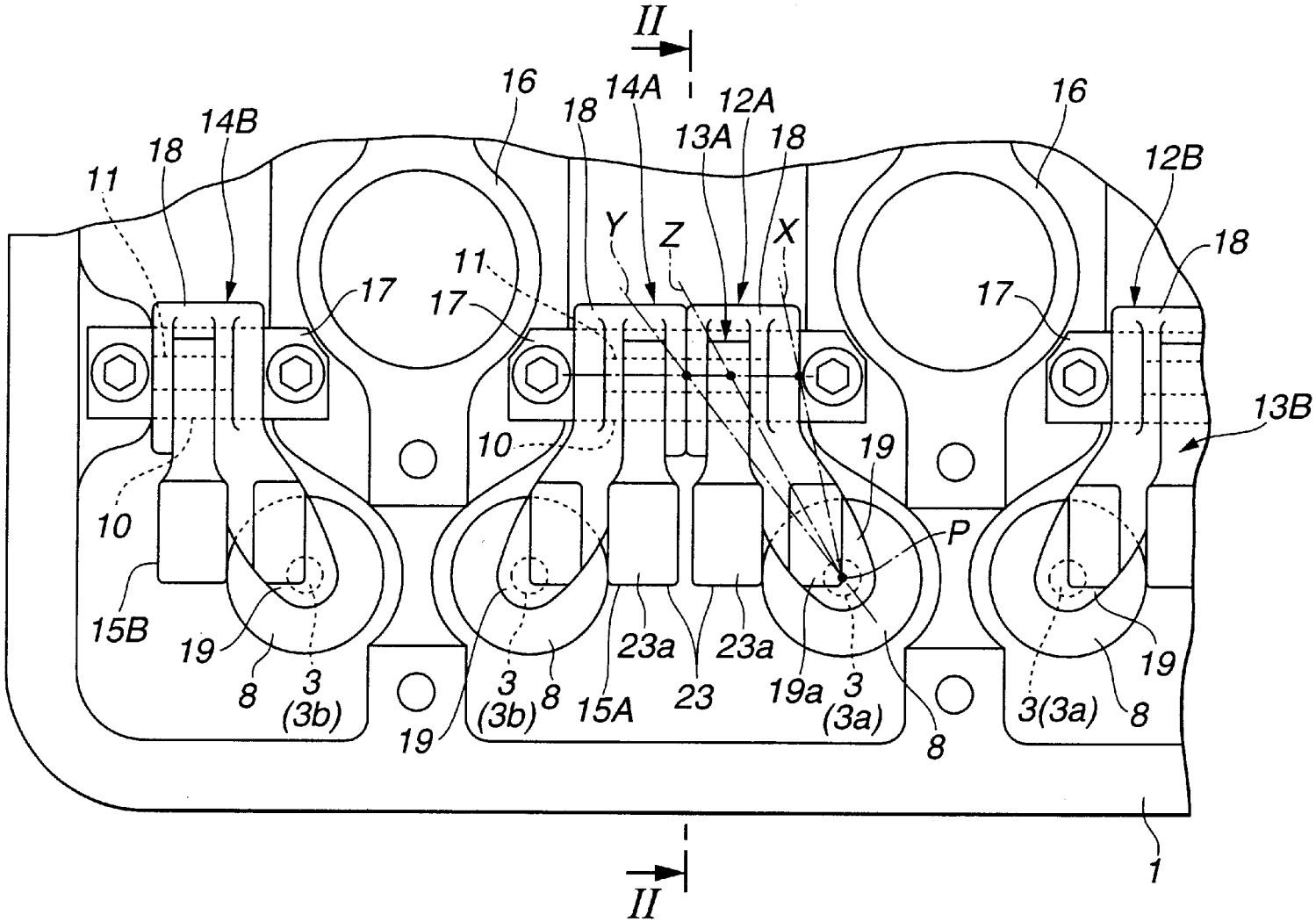
FIG. 1 is a plan view illustrating one embodiment of a valve operating device of the invention.
Figure 2:
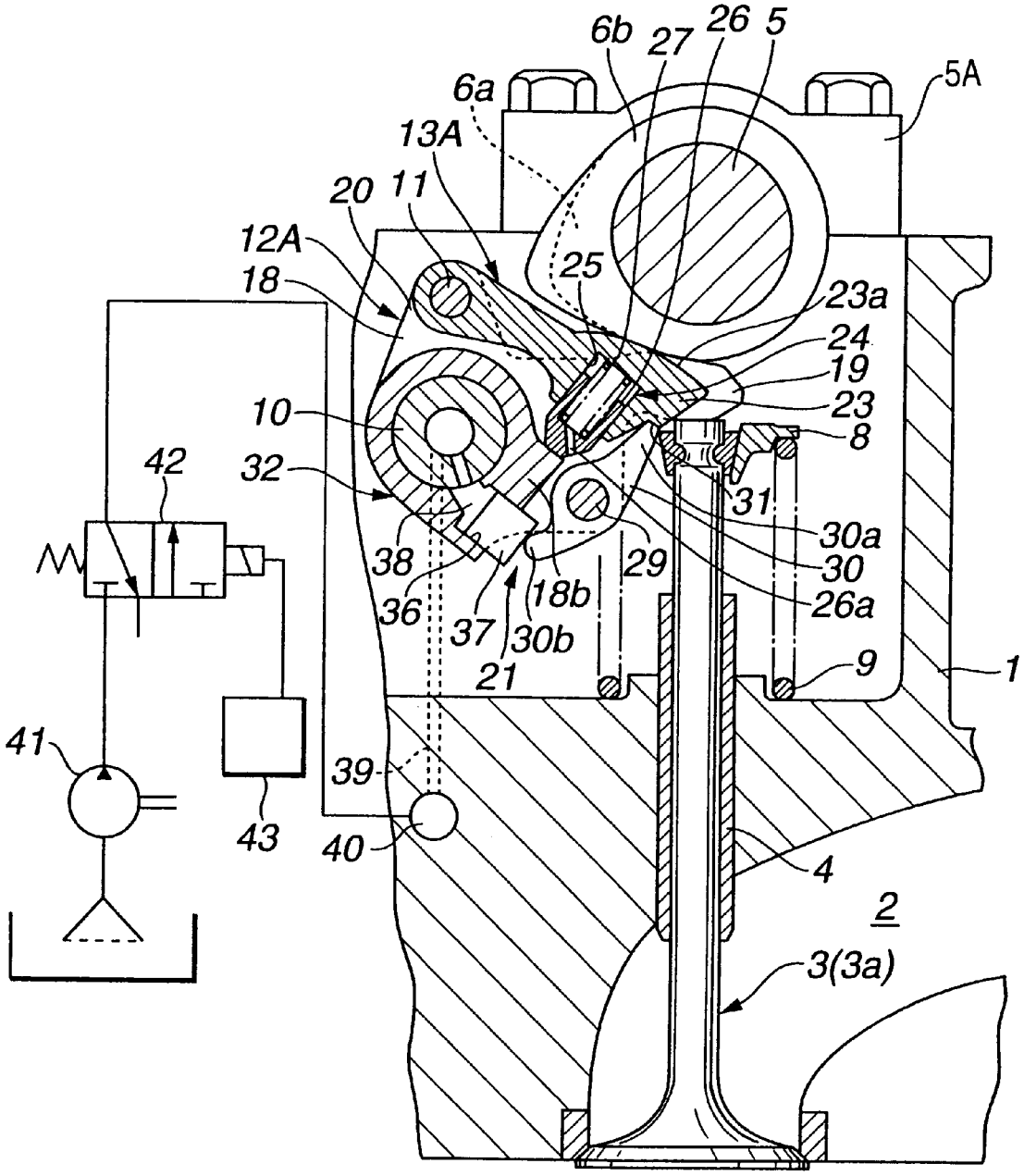
FIG. 2 is a cross sectional view showing the valve operating device of the embodiment, taken along the line II—II of FIG. 1, in which the valve operating device is operating in the high-speed cam operating mode at high engine speeds.
Figure 3:
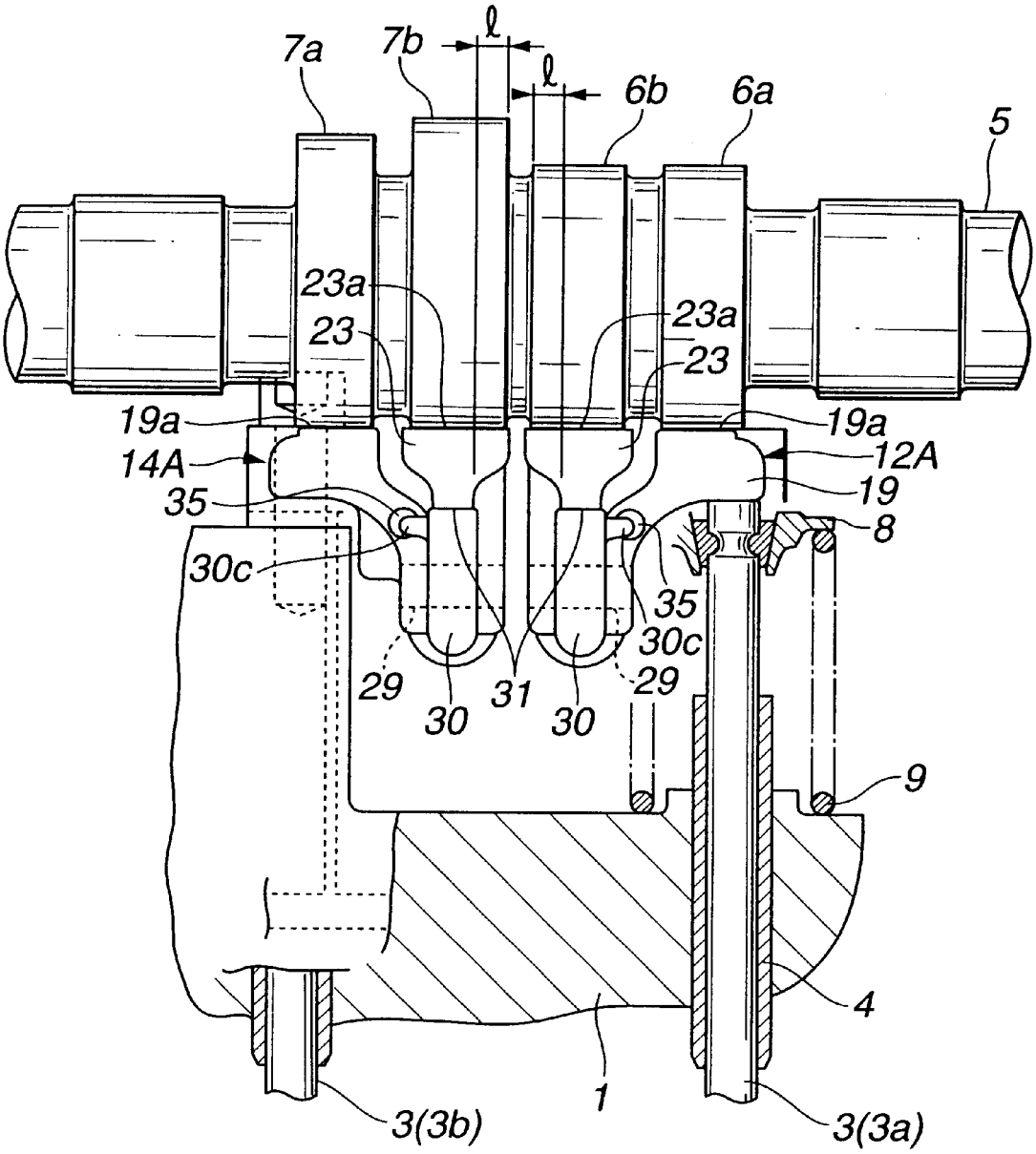
FIG. 3 is a longitudinal cross section illustrating the essential part of the valve operating device of the embodiment shown in FIG. 1.
Figure 4:
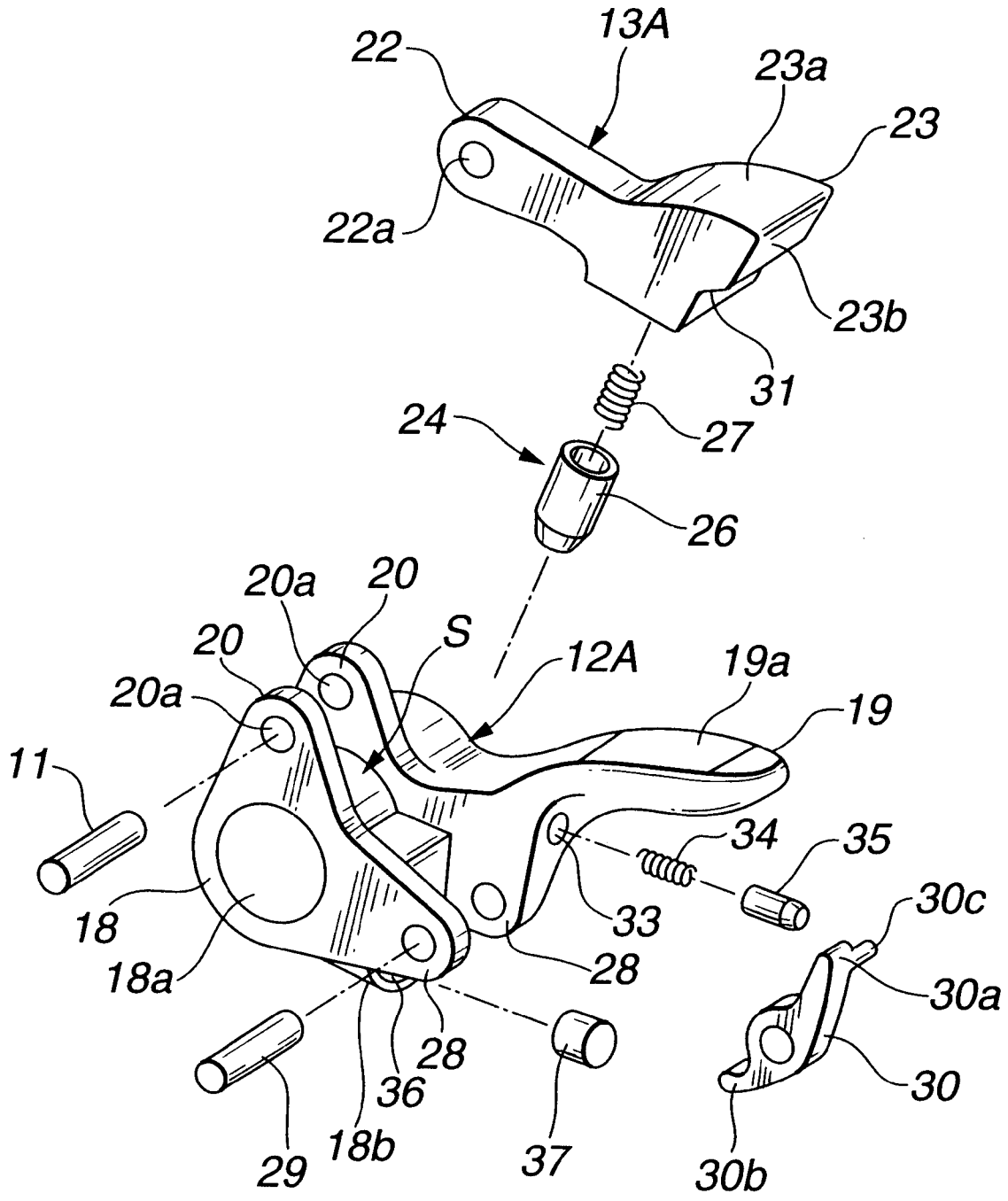
FIG. 4 is a disassembled view illustrating a low-speed rocker arm (12A) and a high-speed rocker arm (13A) employed in the valve operating device of the embodiment.

Referring now to the drawings, particularly to FIGS. 1 through 3, the valve operating device of the invention is exemplified as a valve operating device with a variable valve timing and valve-lift characteristic mechanism for intake valves employed in a multi-cylinder internal combustion engine. The internal combustion engine has two intake-port valves (simply, two intake valves) for each individual engine cylinder. As can be seen from FIGS. 1–3, two intake valves (3, 3) per engine cylinder are located in the cylinder head 1 such that the intake valves are slidable by way of respective cylindrical valve guides (4, 4), so as to open and close the associated intake ports (2, 2). An intake camshaft 5 is arranged above the intake valves (3, 3), and longitudinally located over a plurality of engine cylinders, and has a driven connection with an engine crankshaft (not shown). A journal portion of the intake camshaft 5 is rotatably supported by means of a semi-circular camshaft-journal bearing (not numbered) mounted on the cylinder head 1 and a semi-circular cam-shaft journal bearing (not numbered) of a cam bracket 5A, serving as a bearing cap. The cam bracket 5A is fixedly connected to the cylinder head 1 by way of a pair of bolts. The camshaft 5 is integrally formed on its outer periphery with a pair of low-speed cams 6*a* and 7*a* and a pair of high-speed cams 6*b* and 7*b* for every engine cylinder. As best seen in FIG. 3, a group of cams composed of the low-speed cams (6*a*, 7*a*) and the high-speed cams (6*b*, 7*b*) are located between two adjacent engine cylinders (see FIG. 3). The right-hand low-speed cam 6*a* of the above-mentioned cam group is provided to actuate one intake valve 3*a* of two intake valves (3, 3) included in the right-hand side cylinder of the two adjacent engine cylinders, whereas the left-hand low-speed cam 7*a* of the cam group is provided to actuate one intake valve 3*b* of two intake valves (3, 3) included in the left-hand side cylinder of the two adjacent engine cylinders. The high-speed cams 6*b* and 7*b* are located between the two low-speed cams 6*a* and 7*a*, to actuate the respective intake valves 3*a* and 3*b* during a high-speed cam operating mode (described later). Each of the low-speed cams (6*a*, 7*a*) has a cam profile corresponding to a comparatively small valve-lift characteristic, while each of the high-speed cams (6*b*, 7*b*) has a cam profile corresponding to a comparatively large valve-lift characteristic. Reference sign 8 denotes a valve spring retainer fixedly connected to the valve stem end by means of a collet or a valve-spring-retainer locking device (not numbered). A valve spring 9 is held in place by the spring retainer 8, so as to permanently bias the corresponding intake valve 3 in a direction closing the intake valve. Returning to FIG. 1, reference signs 14B, 14A, 12A, and 12B denote low-speed rocker arms, while reference signs 15B, 15A, 13A, and 13B denote high-speed rocker arms. The low-speed rocker arm 14B is rockably or oscillatingly supported by means of a relatively short, first main rocker shaft 10 to open and close one intake valve (or a first intake valve) 3*b* included in the left-hand side engine cylinder (viewing FIG. 1). The low-speed rocker arm 14A is rockably or oscillatingly supported by means of a relatively long, second main rocker shaft 10 to open and close the other intake valve (or the second intake valve) 3*b* included in the left-hand side engine cylinder. The low-speed rocker arm 12A is rockably or oscillatingly supported by means of the second main rocker shaft 10 to open and close one intake valve (or a third intake valve) 3*a* included in the right-hand side engine cylinder (viewing FIG. 1). The low-speed rocker arm 12B is rockably or oscillatingly supported by means of a relatively long, third main rocker shaft 10 to open and close the other intake valve (or a fourth intake valve) 3*a* included in the right-hand side engine cylinder. On the other hand, the high-speed rocker arm 15B is rockably or oscillatingly supported by means of a relatively short, first sub rocker shaft 11to open and close the first intake valve 3*b* included in the left-hand side engine cylinder (viewing FIG. 1). The high-speed rocker arm 15A is rockably or oscillatingly supported by means of a relatively long, second sub rocker shaft 11 to open and close the second intake valve 3*b* included in the left-hand side engine cylinder. The high-speed rocker arm 13A is rockably or oscillatingly supported by means of the second sub rocker shaft 11 to open and close the third intake valve 3*a* included in the right-hand side engine cylinder. The high-speed rocker arm 13B is rockably or oscillatingly supported by means of a relatively long, third sub rocker shaft 11 to open and close the fourth intake valve 3*a* included in the right-hand side engine cylinder. As shown in FIG. 1, the respective main rocker shafts 10 are formed as a plurality of divided, cylindrical hollow rocker shaft members. Except the relatively short endmost divided rocker shaft members respectively closer to both ends of the engine, each of the remaining relatively long intermediate divided rocker shaft members is disposed substantially between associated two cylinders adjacent to each other. The cylindrical hollow of the main rocker shaft 10 serves as an oil passage as described later. These main rocker shafts 10 are coaxially aligned with each other in the longitudinal direction of the engine. Each of the relatively long main rocker shafts (containing the previously-noted second and third main rocker shafts) except the relatively short two main rocker shafts (containing the previously-noted first main rocker shaft) arranged nearby front and rear ends of the engine, is located between two adjacent annular spark-plug holding boss portions (16, 16) formed in the upper portion of the cylinder head 1. Each of the relatively-short and relatively-long main rocker shafts is supported at both shaft ends by a main-rocker-shaft support bracket 17 which is fixedly connected to the cylinder head 1 by means of rocker-shaft support mounting bolts. As can be seen from FIG. 1, in the two adjacent rocker arm sets, each composed of a low-speed rocker arm and a high-speed rocker arm, the low-speed/high-speed rocker arm arrangement is symmetric. That is, one of the two adjacent rocker arm sets has a symmetric shape with respect to the other. Referring to FIG. 4, there is shown a disassembled view of the rocker arm set composed of the low-speed rocker arm 12A and the high-speed rocker arm 13A. In the shown embodiment, the high-speed rocker arm is operably rockably mounted on the low-speed rocker arm. As can be seen from FIGS. 1 and 4, each of the two adjacent rocker arm sets (12A, 13A; 14A, 15A) includes a base portion 18 rotatably supported by the main rocker shaft 10. The base portion 18 has an insertion hole 18a into which the main rocker shaft 10 is fitted. The right-hand side rocker arm set (12A, 13A) of the two adjacent rocker arm sets (12A, 13A; 14A, 15A) has a radially-outward extending finger-shaped valve-stem end contacting portion 19 bent slightly rightwards from the right-hand end face of the base portion 18 toward the intake valve 3*a*, whereas the left-hand side rocker arm set (14A, 15A) has a radially-outward extending finger-shaped valve-stem end contacting portion 19 bent slightly leftwards from the left-hand end face of the base portion 18 toward the intake valve 3b, so that the two finger-shaped valve-stem end contacting portions (19, 19) are located apart from each other. The lower contact surface of the finger-shaped valve-stem end contacting portion 19 included in the right-hand side rocker arm set (12A, 13A) is in abutted-engagement with the stem end of the third intake valve 3*a* included in the right-hand side engine cylinder, while the lower contact surface of the finger-shaped valve-stem end contacting portion 19 included in the left-hand side rocker arm set 14A, 15A) is in abutted-engagement with the stem end of the second intake valve 3*b* included in the left-hand side engine cylinder. Additionally, the finger-shaped valve-stem end contacting portion 19 of the low-speed rocker arm 12A included in the right-hand side rocker arm set (12A, 13A) is formed at its upper face with a substantially rectangular first follower surface (first cam follower) 19*a* being in sliding-contact with the contacting surface of the low-speed cam 6*a*, whereas the finger-shaped valve-stem end contacting portion 19 of the low-speed rocker arm 14A included in the left-hand side rocker arm set (14A, 15A) is formed at its upper face with a substantially rectangular first follower surface 19*a* being in sliding-contact with the contacting surface of the low-speed cam 7*a*. As shown in FIGS. 1 and 4, the respective base portion 18 is substantially cylindrical in shape, so that it extends in the axial direction of the main rocker shaft 10. Each of the two adjacent rocker arm sets (12A, 13A; 14A, 15A), proximate to each other, is integrally formed at its upper end with a pair of substantially circular-arc shaped flanged bracket portions (20, 20) parallel to each other. As shown in FIG. 4, each of the flanged bracket portions (20, 20) has a relatively small-diameter circular through opening 20*a*. The inside diameter of the circular through opening 20*a* is smaller than that of the insertion hole 18*a* formed in the base portion and fitted onto the main rocker shaft 10. The size and shape of the circular through openings (20*a*, 20*a*) of the two parallel flanged bracket portions (20, 20) are the same, and the two through openings (20*a*, 20*a*) are coaxially aligned to each other. As can be appreciated from FIG. 4, the sub rocker shaft 11 is mounted on the low-speed rocker arm. In more detail, the sub rocker shaft 11 is tightly fitted into the two parallel circular through openings (20*a*, 20*a*) of the two parallel flanged bracket portions (20, 20) of the low-speed rocker arm. The high-speed rocker arm 13A is located in a space (or a substantially rectangular grooved portion) S defined between the two parallel flanged bracket portions (20, 20) integrally formed on the base portion 18 of the right-hand side rocker arm set (12A, 13A), such that the high-speed rocker arm 13A is rockably or oscillatingly supported within the space S by the second sub rocker shaft 11 fitted at its both ends into the through openings (20*a*, 20*a*). On the other hand, the high-speed rocker arm 15A is located in a space (or a substantially rectangular grooved portion) S defined between the two parallel flanged bracket portions (20, 20) formed on the base portion 18 of the left-hand side rocker arm set (14A, 15A). A mode switching device 21, which will be fully described later, is also provided nearby the finger-shaped valve-stem end contacting portion 19 of the respective rocker arm set. As shown in FIGS. 2 and 4, the previously-noted high-speed rocker arm 13A does not have a valve-stem end contacting portion 19 being in abutted-engagement with the stem end of the intake valve 3a. In other words, only the low-speed rocker arm (12A, 12B, 14A, 14B) has the valve-stem end contacting portion 19. In a similar manner, the high-speed rocker arm 15A does not have a valve-stem end contacting portion 19 being in abutted-engagement with the stem end of the intake valve 3*b*. As best seen in FIG. 4, each of the two adjacent high-speed rocker arms (13A, 15A) has a base portion 22. The base portion 22 has a circular through opening 22*a* whose inner periphery is slidably fitted onto the sub rocker shaft 11 mounted on the base portion 18 of the rocker arm set by way of the two parallel flanged bracket portions (20, 20). Thus, the base portion 22 of the high-speed rocker arm (13A, 15A) is rotatable about the sub rocker shaft 11. The two adjacent high-speed rocker arms (13A, 15A) are located proximate to the two low-speed rocker arms (12A, 14A) and arranged between them. Each of the two adjacent high-speed rocker arms (13A, 15A) has a substantially rectangular tongue-shaped portion 23 capable of oscillating up and down in the space S defined between the two parallel flanged bracket portions (20, 20) of the respective low-speed rocker arm (12A, 14A). The tongue-shaped portion 23 of the high-speed rocker arm 13A included in the right-hand side rocker arm set (12A, 13A) is formed at its upper face with a substantially rectangular second follower surface (second cam follower) 23*a* being in sliding-contact with the contacting surface of the high-speed cam 6*b*. Likewise, the tongue-shaped portion 23 of the high-speed rocker arm 15A included in the left-hand side rocker arm set (14A, 15A) is formed at its upper face with a substantially rectangular second follower surface 23*a* being in sliding-contact with the contacting surface of the high-speed cam 7*b*. In the valve operating device of the embodiment, the high-speed rocker arm is oscillatingly mounted on the low-speed rocker arm so that the second follower surface 23*a* is juxtaposed to the first follower surface 19*a* near the associated engine valve. A lost-motion mechanism 24 is located underneath each of the tongue-shaped portions (23, 23) of the high-speed rocker arms (13A, 15A) to provide the delay (lost-motion) between the movement of the high-speed cam and the movement of the second cam follower surface. As best seen in FIG. 2, each of the lost-motion mechanisms (24, 24) includes a cylindrical bore (a cylindrical recessed groove portion) 25 formed in the lower face of the tongue-shaped portion 23 of each of the high-speed rocker arm (13A, 15A), a substantially cylindrical cap-shaped spring retainer 26 slidably accommodated in the bore 25, and a lost-motion spring 27. The lost-motion spring 27 is operably disposed between the innermost end of the bore 25 formed in the tongue-shaped portion 23 and the bottom end of the cap-shaped spring retainer 26, such that the lost-motion spring forces the bottom end face of the spring retainer 26 into contact with the upper face of a protruded portion 18*b* formed in the center of the base portion 18 of the low-speed rocker arm (12A, 14A). An air hole 26*a* is also formed in the bottom end of the spring retainer 26 to insure a smooth sliding motion of the spring retainer 26 in the bore 25.

The previously-described mode switching device 21 is provided for switching between two different valve-lift characteristics, namely a high-speed cam operating mode (or a large valve-lift characteristic) and a low-speed cam operating mode (or a small valve-lift characteristic). Actually, the mode switching device 21 operates to connect and disconnect the low-speed rocker arm (12A, 13A) to and from the high-speed rocker arm (13A, 15A), for the purpose of suitably switching between the high-speed cam operating mode and the low-speed cam operating mode, based on the engine operating conditions. Concretely, as shown in FIGS. 2 and 4, the mode switching device 21 is comprised of a pivot shaft 29, a lever member 30, a stepped portion 31, and a hydraulic actuator 32. The pivot shaft 29 is fixedly connected to a pair of support bracket portions (28, 28) formed integral with the base portion 18 of each of the low-speed rocker arms 12A and 14A. The lever member 30 is rotatably fitted onto the pivot shaft 29. The stepped portion 31 is formed on the lower face of the substantially rectangular tongue-shaped portion 23 of each of the high-speed rocker arms 13A and 15A and capable of engaging with and disengaging from an upper end portion 30*a* of the lever member 30. The hydraulic actuator 32 is provided to apply a push (or a pushing force) onto a lower end portion 30*b* of the lever member 30 or to release the push on the lower end portion 30*b* of the lever member. As can be seen from FIG. 4, the lever member 30 is integrally formed on a side wall of its upper end portion 30*a* with a pin-shaped protruded portion 30*c*. Also, the base portion 18 of each of the low-speed rocker arms 12A and 14A is formed with a return-spring/push-rod mounting bore 33 in which a return spring 34 and a pin-shaped push rod 35 are accommodated. The spring 34 forces the push rod 35 into sliding-contact with the cylindrical curved surface of the protruded portion 30*c* of the lever member 30, so that the upper end portion 30*a* of the lever member 30 is permanently biased in a rotational direction disengaging the upper end portion 30*a* from the stepped portion 31 of the tongue-shaped portion 23 of the high-speed rocker arm (13A, 15A). Under a particular condition where the upper end portion 30*a* of the lever member 30 is disengaged from the stepped portion 31, the mode switching device 21 is designed so that the upper end portion 30*a* is brought into sliding-contact with a slightly inclined front end face 23*b* of the tongue-shaped portion 23 of the high-speed rocker arm. As discussed above, the mode switching device 21 switches the valve-timing and valve-lift characteristic to the high-speed cam operating mode by connecting the low-speed rocker arm (12A, 14A) to the high-speed rocker arm (13A, 15A) during high engine speeds. In contrast to the above, during low engine speeds, the mode switching device 21 switches the valve operating mode to the low-speed cam operating mode by disconnecting the low-speed rocker arm (12A, 14A) from the high-speed rocker arm (13A, 15A). The previously-discussed hydraulic actuator 32 includes a plunger 37 slidably accommodated in a plunger bore 36 formed in the protruded portion 18*b* of the base portion 18, and a hydraulic pressure chamber 38 defined between the inner peripheral wall surface of the plunger bore 36 and the innermost end surface of the plunger 37. Hydraulic pressure of working oil supplied into the hydraulic pressure chamber 38, produces an axially outward movement of the plunger 37. The outermost end of the plunger 37 is in abutted-engagement with the lower end portion 30*b* of the lever member 30. As clearly shown in FIG. 2, hydraulic pressure is supplied from an oil pump 41 through an oil gallery 40 formed in the cylinder head 1 and a hydraulic pressure passage 39 formed in the main rocker shaft 10 and the cylinder head 1 into the hydraulic pressure chamber 38. An electromagnetic directional control valve 42, such as a two-port two-position electromagnetic solenoid valve, is provided in a communication line communicating the outlet port of the oil pump 41 with the oil gallery 40. Depending on the engine operating conditions, the spool valve position of the directional control valve 42 is properly switched between a first valve position (spring-loaded position or de-energized position) in which the hydraulic system (containing the hydraulic actuator 32) permits hydraulic pressure created by the pump 41 to be supplied into the hydraulic pressure chamber 38, and a second valve position (energized position) in which the hydraulic system permits the hydraulic pressure in the hydraulic pressure chamber 38 to be drained. Actually, the valve position of the electromagnetic directional control valve 42 is switched in response to a control command signal from a controller or an electronic engine control module (ECM) 43, so as to properly open or close the oil gallery 40 depending on the engine operating conditions. The controller 43 is provided to execute a variable valve timing and valve-lift characteristic adjustment. The controller 43 generally comprises a microcomputer. Although it is not clearly shown for the purpose of illustrative simplicity, the controller 43 usually includes an input port or an input interface, a microprocessor (CPU), memories (RAM, ROM), an output port or an output interface, drivers or driver circuits, and the like. The driver circuits are often used for amplification of output signals from the controller 43. The CPU performs necessary arithmetic calculations, processes informational data, performs logical operations with stored data, and makes necessary decisions of acceptance. The memories are constructed by a random-access memory (RAM) and a read-only memory (ROM). The ROM (fixed-value memory) permanently stores all necessary programs, various sorts of characteristic maps, theoretical values, and the like, while the RAM (operating-data memory) temporarily stores informational data during execution of the control program. For instance, data delivered by engine/vehicle sensors are stored in the RAM, until they are summoned by the CPU or superseded by more recent data. For example, the input port of the controller 43 receives various engine/vehicle sensor signals from a crank angle sensor (not shown), an air-flow meter (not shown), and an engine temperature sensor (not shown). The air-flow meter is located on the intake-air duct for detecting a quantity of intake air flowing through the air-flow meter and drawn into the engine. The crank angle sensor is provided to monitor engine speed as well as a relative position of the engine crankshaft. A coolant temperature sensor is usually used as the engine temperature sensor. The coolant temperature sensor is mounted on the engine and usually screwed into one of top coolant passages to sense the actual operating temperature of the engine. The input informational data signals from the above engine/vehicle sensors are used for the arithmetic and logical operations executed by the CPU. Actually, the CPU of the controller 43 performs various data processing actions needed for the variable valve timing and valve-lift characteristic control. The output port of the controller 43 is configured to be electronically connected often through the driver circuits to electrical loads, that is, the electromagnetic directional control valve 42 contained in the hydraulic actuator 32, for generating the control command signal based on the more recent engine operating conditions to operate or energize this electrical load (electromagnetic solenoid valve 42).

The operation of the valve operating device of the embodiment is described hereunder.

Figure 5:
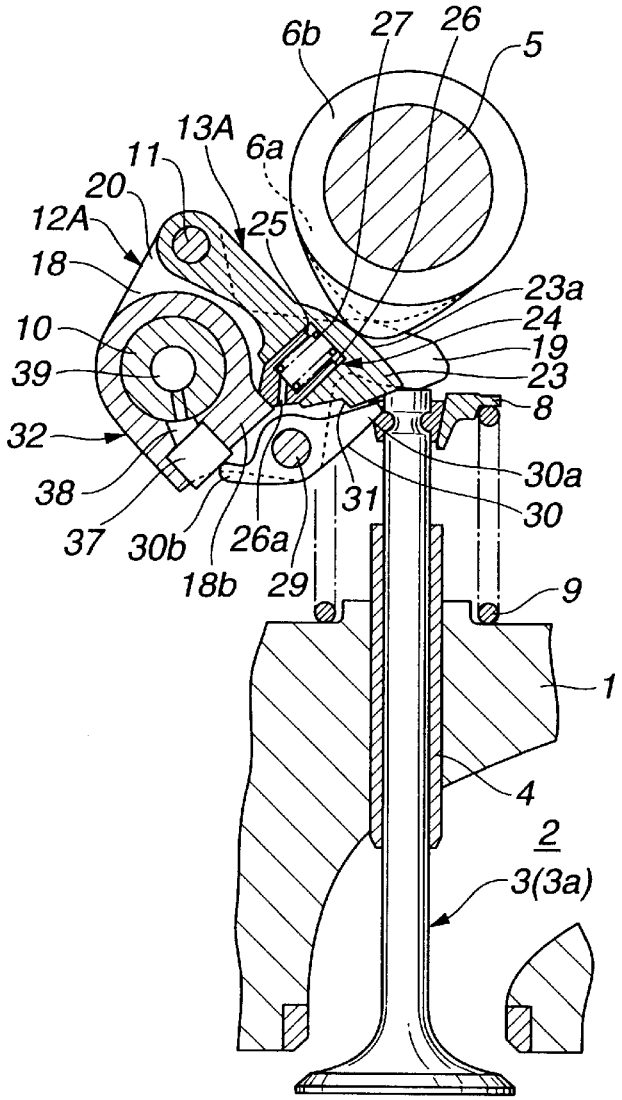
FIG. 5 is a cross sectional view showing the valve operating device of the embodiment, in which the valve operating device is operating in the low-speed cam operating mode at low engine speeds, in contrast to the high-speed cam operating mode of FIG. 2.
Figure 6:
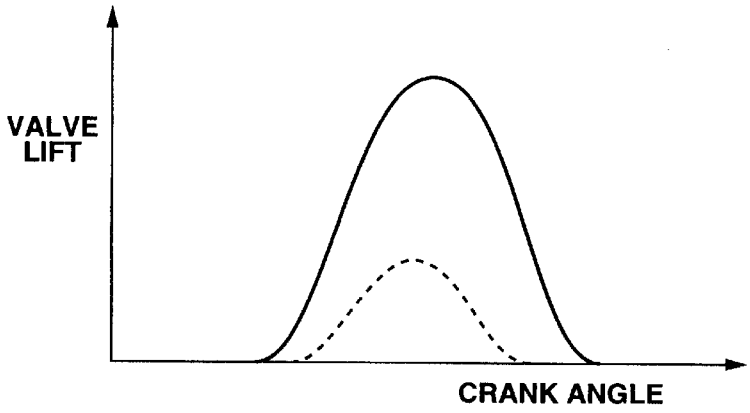
FIG. 6 is a graph of two valve-lift characteristic curves obtained in the low-speed cam operating mode and the high-speed cam operating mode.

During starting the engine or during engine operation at low engine speeds, the low-speed rocker arms 12A and 14A oscillatingly move in accordance with the cam profiles of the respective low-speed cams 6*a* and 7*a*. As a result of this, the valve timing and valve-lift characteristic (lifted period and valve lift) of each of the intake valves 3*a* and 3*b* varies in accordance with a relatively small valve-lift characteristic indicated by the broken line shown in FIG. 6. In this case, the high-speed rocker arms 13A and 15A are oscillated by the respective high-speed cams 6*b* and 7*b*. However, the upper end portion 30*a* of the lever member 30 is urged apart from the stepped portion 31 of the high-speed rocker arm by means of the push rod 35 outwardly biased by the return spring 34. That is to say, as shown in FIG. 5, the lever member 30 rotates clockwise and is spaced apart from the stepped portion 31 and in lieu thereof the upper end portion 30*a* of the lever member 30 is brought into sliding-contact with the inclined front end face 23*b* of the tongue-shaped portion 23 of the high-speed rocker arm, and thus the valve system allows a function of the lost-motion mechanism 24. Therefore, by virtue of the lost-motion mechanism 24 being in operation, the oscillating forces of the high-speed rocker arms 13A and 15A are not transmitted into the respective low-speed rocker arms 12A and 14A, irrespective of the presence or absence of input from the high-speed cam (6*b*, 7*b*) into the high-speed rocker arm (13A, 15A), while the oscillating motion of each of the low-speed rocker arms 12A and 14A can be maintained.

Conversely, when the operating condition of the engine is shifted from a low-speed range (or a mid-speed range) to a high-speed range, the spool valve position of the electromagnetic directional control valve 42 is switched to the second valve position (or the energized position) in response to the control command signal from the controller 43. This permits hydraulic-pressure supply from the oil pump 41 through the previously-described communication line, the oil gallery 40, and the hydraulic pressure passage 39 into the hydraulic pressure chamber 38. As a result, the plunger 37 pushes the lower end portion 30*b* of the lever member 30 against the spring bias of the return spring 34. At the same time, each of the high-speed rocker arms 13A and 15A moves upward by virtue of the lost-motion spring 27 of the lost-motion mechanism 24. As can be seen from FIG. 2, the lever member 30, therefore, rotates counterclockwise, and then the upper end portion 30*a* is brought into engagement with the stepped portion 31 of the substantially rectangular tongue-shaped portion 23 of the low-speed rocker arm. As a consequence, the high-speed rocker arm 13A is engaged with or connected to the low-speed rocker arm 12A, while the high-speed rocker arm 15A is engaged with or connected to the low-speed rocker arm 14A. In this case, the low-speed rocker arm 12A oscillates in accordance with the oscillating motion of the high-speed rocker arm 13A, while the low-speed rocker arm 14A oscillates in accordance with the oscillating motion of the high-speed rocker arm 15A. The first follower surfaces (19*a*, 19*a*) of the low-speed rocker arms (12A, 14A) are held apart from the respective contacting surfaces of the low-speed cams 6*a* and 7*a*. Thus, the intake valves 3*a* and 3*b* are opened and closed in accordance with the respective cam profiles of the high-speed cams 6*b* and 7*b*. As a result, the valve timing and valve-lift characteristic (lifted period and valve lift) of each of the intake valves 3*a* and 3*b* varies in accordance with a relatively large valve-lift characteristic indicated by the solid line shown in FIG. 6. In such a case, the valve operating device of the embodiment can provide a comparatively large engine power output owing to an increased intake-air quantity based on the large valve-lift characteristic.

Briefly speaking, the valve operating device of the invention includes a camshaft adapted to be driven by a crankshaft, at least one cam pair including a low-speed cam and a high-speed cam, each operating an associated valve of at least two engine valves included in a cylinder, and integrally formed on an outer periphery of the camshaft, a main rocker shaft supported on a cylinder head, a sub rocker shaft, at least one rocker arm set including a low-speed rocker arm having a first follower driven by the low-speed cam for operating the associated valve during a low-speed cam operating mode and oscillatingly supported by the main rocker shaft and mounting thereon the sub rocker shaft, and a high-speed rocker arm having a second follower driven by the high-speed cam for operating the associated valve during a high-speed cam operating mode and oscillatingly supported by the sub rocker shaft, the second follower of the high-speed rocker arm being closely juxtaposed to the first follower and located within a dead space defined in an outside of the at least two engine valves included in the engine cylinder, and a mode switching device provided for switching from one of the low-speed and high-speed cam operating modes to the other depending on engine operating conditions. The mode switching device initiates the low-speed cam operating mode by disconnecting the low-speed rocker arm from the high-speed rocker arm, and also initiates the high-speed cam operating mode by connecting the low-speed rocker arm to the high-speed rocker arm. As discussed above, the main rocker shaft includes a plurality of divided rocker shaft members supported on the cylinder head and including relatively short endmost rocker shaft members respectively located closer to both ends of the engine and relatively long intermediate divided rocker shaft members each being disposed between associated two cylinders adjoining to each other, and each of the plurality of divided rocker shaft members oscillatingly supports the low-speed rocker arm of the rocker arm set. The at least one rocker arm set includes two adjacent rocker arm sets disposed between the associated two cylinders adjoining to each other, one of the two adjacent rocker arm sets has a symmetric shape with respect to the other, and the low-speed rocker arm included in the one rocker arm set and the low-speed rocker arm included in the other rocker arm set are oscillatingly supported on the same one of the relatively long intermediate divided rocker shaft members. The high-speed rocker arm included in the one rocker arm set and the high-speed rocker arm included in the other rocker arm set are closely juxtaposed to each other and disposed between two adjacent engine valves respectively included in the associated two cylinders adjoining to each other. The low-speed rocker arm has a first base portion rockably supported by the main rocker shaft and a grooved portion formed in the base portion, and the high-speed rocker arm has a second base portion rockably supported by the sub rocker shaft within the grooved portion of the first base portion. The low-speed rocker arm included in the one rocker arm set has a first finger-shaped valve-stem-end contacting portion formed at a free end thereof with the first follower and bent from the first base portion of the low-speed rocker arm included in the one rocker arm set toward a first one of the two adjacent engine valves respectively included in the associated two cylinders adjoining to each other, whereas the low-speed rocker arm included in the other rocker arm set has a second finger-shaped valve-stem-end contacting portion formed at a free end thereof with the first follower and bent from the first base portion of the low-speed rocker arm included in the other rocker arm set toward a second one of the two adjacent engine valves respectively included in the associated two cylinders adjoining to each other, and a direction bending the first finger-shaped valve-stem-end contacting portion and a direction bending the second finger-shaped valve-stem-end contacting portion are dimensioned so that the first finger-shaped valve-stem-end contacting portion and the second finger-shaped valve-stem-end contacting portion are spaced apart from each other. The second follower of the high-speed rocker arm included in the one rocker arm set and the second follower of the high-speed rocker arm included in the other rocker arm set are closely juxtaposed to each other and disposed between the first follower of the lower-speed rocker arm included in the one rocker arm set and the first follower of the lower-speed rocker arm included in the other rocker arm set.

As will be appreciated from the above, in the valve operating device discussed above, the high-speed rocker arms 13A and 15A are disposed between two intake valves 3*a* and 3*b*, which valves adjoin each other and are included in respective adjacent engine cylinders, thus ensuring an effective use of a comparatively large dead space defined between the two adjacent intake port valves and extending in a direction perpendicular to the longitudinal direction of the engine. Thus, it is possible to set an oscillating stroke of each of the high-speed rocker arms 13A and 15A to a large stroke. In other words, the low-speed/high-speed rocker arm arrangement of the valve operating device enables an adequate stroke difference between an oscillating stroke created by the low-speed rocker arm (12A, 14A) and an oscillating stroke created by the high-speed rocker arm (13A, 15A), owing to the effective use of the dead space, and ensures an optimal selection of a relatively small valve-lift characteristic suitable to low engine speeds and a relatively large valve-lift characteristic suitable to high engine speeds, depending on various engines having different specifications. This insures increased engine design flexibility as well as enhanced engine performance all over the engine operating range. Additionally, according to the valve operating device of the invention, it is possible to variably control a valve lift without changing the layout of existing engine component parts such as an intake camshaft. Therefore, the valve operating device discussed above can be applied to various sorts of engines without largely changing the existing cylinder-head structure. This enhances a manufacturing efficiency, and minimizes a rise in production costs. Furthermore, a rocker arm set, that is, a pair of low-speed and high-speed rocker arms (12A,13A; 12B,13B; 14A,15A; 14B,15B) are provided for each engine valve (each intake valve (3*a*, 3*b*) in the shown embodiment). Thus, it is possible to independently variably control a valve lift for each individual engine valve (each individual intake valve) of each of engine cylinders. For instance, during operation of the engine at low speeds, it is possible to produce a controlled swirl flow in each engine cylinder, utilizing a comparatively large valve-lift difference between two intake valves included in each individual engine cylinder, thus ensuring improved combustion stability. Moreover, two rocker arm sets (12A,13A; 14A,14A) are arranged between two adjacent engine cylinders, and one of these rocker arm sets is constructed by integrally connecting a high-speed rocker arm 13A to a low-speed rocker arm 12A and also the other of these rocker arm sets is constructed by integrally connecting a high-speed rocker arm 15A to a low-speed rocker arm 14A. The pair of low-speed rocker arms 12A and 14A, respectively operating the two intake valves 3*a* and 3*b*, which valves adjoin each other and are included in respective adjacent engine cylinders, are juxtaposed to each other and rotatably mounted on the same main rocker shaft 10, thereby reducing the entire size of the valve operating device. Additionally, one finger-shaped valve-stem end contacting portion 19 of each of the low-speed rocker arms (12A, 14A) is slightly bent toward the associated intake valve (3*a*, 3*b*), taking substantially the shortest distance, thus enables an effective use of an upper space of the intake-valve side. This contributes to small-sizing of the valve operating device (particularly, small-sizing of the rocker-arm set). The previously-discussed rocker-arm arrangement effectively suppresses an increase in inertial mass of each of the rocker arms (12A, 14A, 13A, 15A; 12B; 14B).

Figure 7:
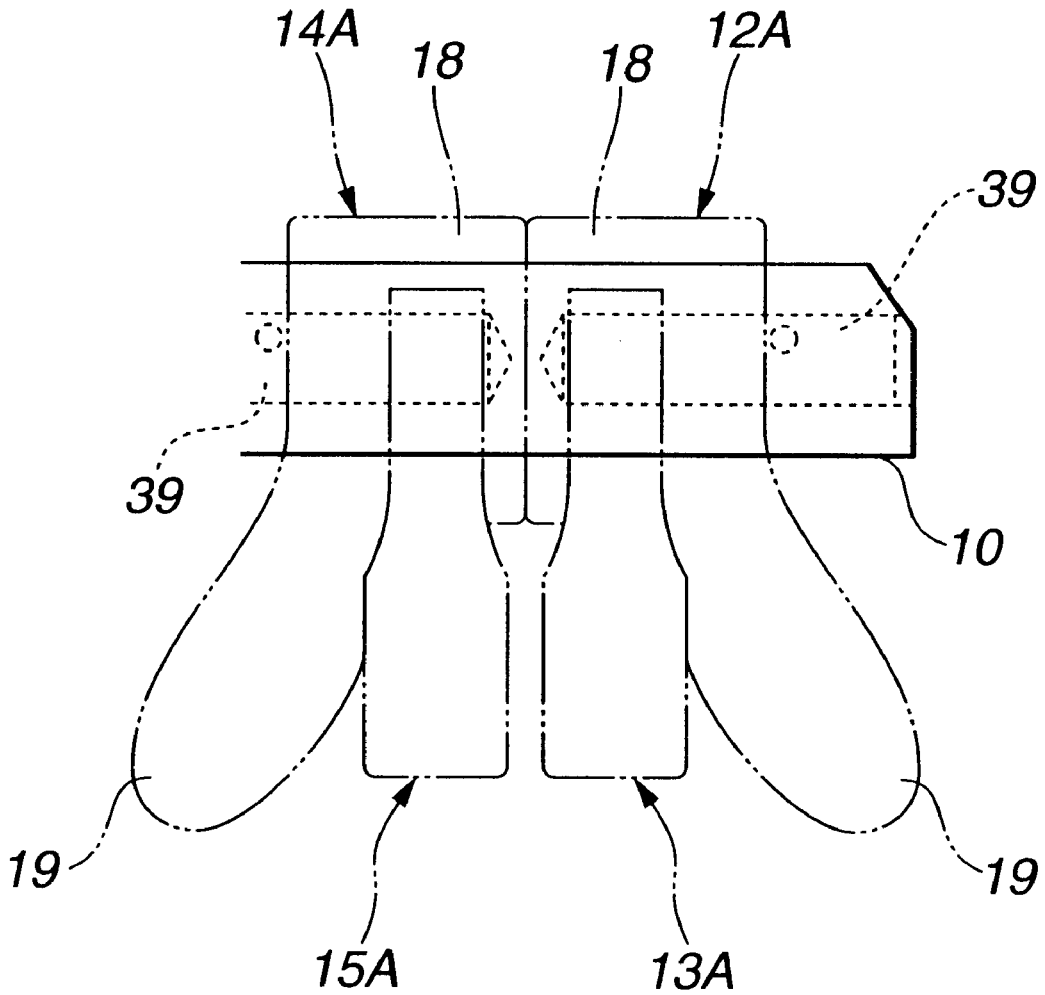
FIG. 7 is a schematic view illustrating the essential part of one modification of the valve operating device of the invention.

As regards the low-speed rocker arms 12A and 14A, as can be seen from the plan view of FIG. 1, the low-speed-rocker-arm base portion 18 is designed to extend in the axial direction of the main rocker shaft 10. In addition, the valve-stem end contacting portion 19 of each low-speed rocker arm is dimensioned or shaped to extend in a substantially radial direction perpendicular to the direction that the base portion 18 extends, so that the valve-stem end contacting portion 19 is bent slightly outwardly from one end face of the base portion toward the associated intake valve. The load, applied to the base portion 18 owing to a reaction (push-back force) of the valve spring 9 during operation of the low-speed rocker arm, acts on a line Z lying between the line segment X including the axis of the valve stem and the intersection of the axis of the main rocker shaft 10 and the one end face of the base portion 18 and the line segment Y including the axis of the valve stem and the intersection of the axis of the main rocker shaft 10 and the other end face of the base portion 18. In more detail, the point of reaction of the valve spring is offset outwardly from the one end face of the base portion 18 of the low-speed rocker arm, thus resulting in a bending moment acting on the base portion 18. As discussed above, the base portion 18 is rotatably supported on the main rocker shaft 10 by fitting the main rocker shaft 10 into the insertion hole 18a formed in the base portion 18. When the load (or bending moment) is applied via the valve-stem end to the base portion 18 by the reaction force of the valve spring, the base portion 18 tends to be somewhat inclined with respect to the axis of the main rocker shaft 10, owing to clearance-fit between the inner peripheral wall surface of the insertion hole 18*a* of the base portion 18 and the outer peripheral wall surface of the main rocker shaft 10. In the valve operating device of the shown embodiment, however, the load, applied to the base portion 18 during operation of the engine, acts on the line Z lying between the line segments X and Y, and additionally the line Z passes through a point near the center of the base portion 18. A degree of inclination of the base portion 18 with respect to the axis of the main rocker shaft 10 is thus negligible, thereby minimizing the offset load acting on the base portion 18, in particular the circumferentially-extending inside edge of the base portion 18 near each opening end of the insertion hole 18*a*, and thus minimizing unbalanced wear occurring at the contacting portions between the circumferentially-extending inside edges of both ends of the insertion hole 18*a* of the base portion 18 and the outer peripheral wall surface of the main rocker shaft 10, and also minimizing unbalanced wear occurring at the contacting surface between the first cam follower surface 19*a* and the low-speed cam (6*a*, 7*a*). During the high-speed cam operating mode, the second cam follower surface 23*a* being out of the area defined between the two line segments X and Y, follows the cam profile of the high-speed cam (6*b*, 7*b*). As a matter of course, the point of application of the force transmitted from the high-speed cam to the second cam follower surface 23*a*, lies on the second cam follower surface 23*a*, thus resulting in a somewhat bending moment acting on the rocker arm set (12A,13A; 14A,15A). In this case, the high-speed rocker arm (13A, 15A) tends to be inclined together with the low-speed rocker arm (12A, 14A) toward the second cam follower surface 23*a* of the high-speed rocker arm. However, as seen in FIG. 2, during the high-speed cam operating mode the second follower surface 23*a* is effectively pushed against the high-speed cam (6*b*, 7*b*) via the stepped portion 31 (having a substantially T-shaped cross section (see FIG. 3) and formed on the lower face of the substantially rectangular tongue-shaped portion 23 of the high-speed rocker arm (13A, 15A)), thus preventing unbalanced abutment between the second cam follower surface 23*a* and the cam profile of the high-speed cam (6*b*, 7*b*). This minimizes unbalanced wear occurring at the contacting surface between the second cam follower surface 23*a* and the high-speed cam (6*b*, 7*b*). Moreover, in the valve operating device of the previously-discussed embodiment, the low-speed/high-speed rocker arm set (12A,13A; 12B, 13B; 14A,15A; 14B,15B) is provided for each individual engine valve (for each individual intake valve (3*a*, 3*b*)). Therefore, as shown in FIG. 7, assuming that hydraulic pressure passages 39, which passages communicate the respective hydraulic pressure chambers 38 defined in the low-speed rocker arms 12A, 12B, 14A, and 14B, are formed independently of each other, and additionally an electromagnetic directional control valve 42 is provided for each individual hydraulic pressure passage 39, the valve operating device of the embodiment enables independent hydraulic-pressure control (independent pressure supply to or independent pressure release from each individual pressure chamber 38). With the previously-noted hydraulic system arrangement, if the valve operating device of the embodiment is applied to a multi-cylinder engine with two intake ports for each individual engine cylinder, it is possible to operate one of the two intake ports at a high-speed cam operating mode and to operate the other at a low-speed cam operating mode, thus enabling a controlled valve-lift difference between the two intake valves. This realizes a controlled swirl flow (a clockwise swirl flow, a counterclockwise swirl flow, or a strengthened swirl flow or a weakened swirl flow) for each engine cylinder. Also, it is possible to generate swirl flow in the same direction of rotation of gas flow for every engine cylinder. As a consequence, it is possible to properly select the direction of rotation of swirl flow, accounting for a mounting state of an intake manifold on a cylinder head. This ensures an optimal swirling effect, thereby insuring improved combustion stability all over the engine operating range.

In the shown embodiment, the valve operating device of the invention is exemplified as a valve operating device with a variable valve timing and valve-lift characteristic mechanism for intake valves employed in a multi-cylinder engine. It will be appreciated that the fundamental concept of the invention can be applied to a valve operating device with a variable valve timing and valve-lift characteristic mechanism for exhaust valves employed in a multi-cylinder engine.

The entire contents of Japanese Patent Application No. P11-193820 (filed Jul. 8, 1999) is incorporated herein by reference.

While the foregoing is a description of the preferred embodiments carried out the invention, it will be understood that the invention is not limited to the particular embodiments shown and described herein, but that various changes and modifications may be made without departing from the scope or spirit of this invention as defined by the following claims.

What is claimed is:

1. A valve operating device for an internal combustion engine having at least two engine valves per cylinder, said valve operating device enabling both valve timing and valve-lift characteristic to be varied depending on engine operating conditions, comprising:

a camshaft adapted to be driven by a crankshaft;

at least one cam pair including a low-speed cam and a high-speed cam, each operating an associated valve of at least two engine valves included in a cylinder, the cam pair being formed on said camshaft;

a main rocker shaft supported on a cylinder head, the main rocker shaft comprising a plurality of divided rocker shaft members supported on the cylinder head and including relatively short endmost rocker shaft members respectively located closer to both ends of the engine and relatively long intermediate divided rocker shaft members each being disposed between associated two cylinders adjoining to each other;

at least one rocker arm set including:

(a) a low-speed rocker arm having a first follower driven by the low-speed cam for operating the associated valve during a low-speed cam operating mode and supported by said main rocker shaft; and (b) a high-speed rocker arm having a second follower driven by the high-speed cam for operating the associated valve during a high-speed cam operating mode and mounted on the low speed rocker arm, the second follower of the high-speed rocker arm being closely juxtaposed to the first follower and located within a dead space defined in an outside of the at least two engine valves included in the engine cylinder; and a mode switching device provided for switching from one of the low-speed and high-speed cam operating modes to the other depending on the engine operating conditions, said mode switching device initiating the low-speed cam operating mode by disconnecting the low-speed rocker arm from the high-speed rocker arm, and initiating the high-speed cam operating mode by connecting the low-speed rocker arm to the high-speed rocker arm.

2. A valve operating device for an internal combustion engine having at least two engine valves per cylinder, said valve operating device enabling both valve timing and valve-lift characteristic to be varied depending on engine operating conditions, comprising:

a camshaft adapted to be driven by a crankshaft;

at least one cam pair including a low-speed cam and a high-speed cam, each operating an associated valve of at least two engine valves included in a cylinder, and integrally formed on an outer periphery of said camshaft;

a main rocker shaft supported on a cylinder head;

a sub rocker shaft;

at least one rocker arm set including:

(a) a low-speed rocker arm having a first follower driven by the low-speed cam for operating the associated valve during a low-speed cam operating mode and oscillatingly supported by said main rocker shaft and mounting thereon said sub rocker shaft; and (b) a high-speed rocker arm having a second follower driven by the high-speed cam for operating the associated valve during a high-speed cam operating mode and oscillatingly supported by said sub rocker shaft, the second follower of the high-speed rocker arm being closely juxtaposed to the first follower and located within a dead space defined in an outside of the at least two engine valves included in the engine cylinder; and a mode switching device provided for switching from one of the low-speed and high-speed cam operating modes to the other depending on the engine operating conditions, said mode switching device initiating the low-speed cam operating mode by disconnecting the low-speed rocker arm from the high-speed rocker arm, and initiating the high-speed cam operating mode by connecting the low-speed rocker arm to the high-speed rocker arm, wherein said main rocker shaft comprises a plurality of divided rocker shaft members supported on the cylinder head and including relatively short endmost rocker shaft members respectively located closer to both ends of the engine and relatively long intermediate divided rocker shaft members each being disposed between associated two cylinders adjoining to each other, and each of the plurality of divided rocker shaft members oscillatingly supports the low-speed rocker arm of said rocker arm set.

3. The valve operating device as claimed in claim 2, wherein said at least one rocker arm set comprises two adjacent rocker arm sets disposed between the associated two cylinders adjoining to each other, one of the two adjacent rocker arm sets has a symmetric shape with respect to the other, and the low-speed rocker arm included in the one rocker arm set and the low-speed rocker arm included in the other rocker arm set are oscillatingly supported on a same one of the relatively long intermediate divided rocker shaft members.

4. The valve operating device as claimed in claim 3, wherein the high-speed rocker arm included in the one rocker arm set and the high-speed rocker arm included in the other rocker arm set are closely juxtaposed to each other and disposed between two adjacent engine valves respectively included in the associated two cylinders adjoining to each other.

5. The valve operating device as claimed in claim 4, wherein the low-speed rocker arm has a first base portion rockably supported by said main rocker shaft and extending in an axial direction of said main rocker shaft and a grooved portion formed in the base portion, and the high-speed rocker arm has a second base portion rockably supported by said sub rocker shaft within the grooved portion of the first base portion.

6. The valve operating device as claimed in claim 5, wherein the low-speed rocker arm included in the one rocker arm set has a first finger-shaped valve-stem-end contacting portion formed at a free end thereof with the first follower and bent from the first base portion of the low-speed rocker arm included in the one rocker arm set toward a first one of the two adjacent engine valves respectively included in the associated two cylinders adjoining to each other, and the low-speed rocker arm included in the other rocker arm set has a second finger-shaped valve-stem-end contacting portion formed at a free end thereof with the first follower and bent from the first base portion of the low-speed rocker arm included in the other rocker arm set toward a second one of the two adjacent engine valves respectively included in the associated two cylinders adjoining to each other, and a direction bending the first finger-shaped valve-stem-end contacting portion and a direction bending the second finger-shaped valve-stem-end contacting portion are dimensioned so that the first finger-shaped valve-stem-end contacting portion and the second finger-shaped valve-stem-end contacting portion are spaced apart from each other.

7. The valve operating device as claimed in claim 6, wherein the second follower of the high-speed rocker arm included in the one rocker arm set and the second follower of the high-speed rocker arm included in the other rocker arm set are closely juxtaposed to each other and disposed between the first follower of the lower-speed rocker arm included in the one rocker arm set and the first follower of the lower-speed rocker arm included in the other rocker arm set.

8. The valve operating device as claimed in claim 1, wherein the high-speed rocker arm operates the valve during the high-speed cam operating mode by transmitting an oscillating motion to the low-speed rocker arm.

9. The valve operating device as claimed in claim 8, further comprising a sub rocker shaft mounted on the low-speed rocker arm for oscillatingly supporting the high-speed rocker arm.

10. The valve operating device as claimed in claim 9, wherein a diameter of the sub rocker shaft is smaller than a diameter of the main rocker shaft.

11. The valve operating device as claimed in claim 10, wherein the rocker arm set further includes:

(c) a lost motion mechanism provided between the low-speed rocker arm and the high-speed rocker arm for providing a delay of a movement between the high-speed cam and the second follower, the lost motion mechanism comprising:

a cylindrical bore formed in a lower face of the high-speed rocker arm;

a spring retainer slidably accommodated in the cylindrical bore; and a spring disposed between the cylindrical bore and the spring retainer for forcing the spring retainer into a contact with the low-speed rocker arm.

12. The valve operating device as claimed in claim 11, wherein a hole is formed in a bottom end of the spring retainer.

13. The valve operating device as claimed in claim 12, wherein the low-speed cam and the high-speed cam included in the cam pair are located between two associated cylinders adjoining each other.

14. The valve operating device as claimed in claim 13, wherein each of the relatively long intermediate divided rocker shaft members supports two adjacent rocker arm sets disposed between the associated cylinders adjoining each other, one of the adjacent rocker arm sets operates one of the valves included in one of the associated cylinders, and the other of the adjacent rocker arm sets operates one of the valves included in the other of the associated cylinders; and wherein each of the relatively short endmost rocker shaft members supports one rocker arm set that operates one of the valves included in an engine cylinder arranged near front and rear ends of the engine.

15. The valve operating device as claimed in claim 14, wherein two high-speed rocker arms included in the adjacent rocker arm sets are arranged between the low-speed rocker arms of the adjacent rocker arm sets.

16. The valve operating device as claimed in claim 15, wherein said one of the adjacent rocker arm sets has a symmetric shape with respect to the other, and the low-speed rocker arm included in said one of the adjacent rocker arm sets and the low-speed rocker arm included in the other of the adjacent rocker arm sets are oscillatingly supported on a same one of the relatively long intermediate divided rocker shaft members.

17. The valve operating device as claimed in claim 16, wherein the high-speed rocker arm included in said one of the adjacent rocker arm sets and the high-speed rocker arm included in the other of the adjacent rocker arm sets are closely juxtaposed to each other.

18. The valve operating device as claimed in claim 17, wherein the low-speed rocker arm has a first base portion rockably supported by the main rocker shaft and a grooved portion formed in the base portion, the first base portion extends in an axial direction of the main rocker shaft, and the high-speed rocker arm has a second base portion rockably supported by the sub rocker shaft within the grooved portion of the first base portion.

19. The valve operating device as claimed in claim 18, wherein the mode switching device comprises:

a pivot shaft connected to a pair of support bracket portions formed on the base portion of the low-speed locker arm;

a lever member rotatably fitted onto the pivot shaft, the lever member including a protruded portion formed on a side wall of its upper end portion;

a stepped portion formed on the lower face of the high-speed rocker arm;

a bore formed on the base portion of the low-speed rocker arm, the bore being located at a corresponding portion to the protruded portion;

a push-rod accommodated in the bore formed into pin-shape;

a return-spring provided between the bore and the push-rod for forcing the push-rod into sliding-contact with the protruded portion;

a hydraulic system for applying a push onto a lower end portion of the lever member, or releasing the push on the lower end portion, the hydraulic actuator including a plunger bore formed on the base portion, a plunger accommodated in the plunger bore, a hydraulic pressure chamber defined by the plunger bore and the plunger, a pump for supplying a hydraulic pressure to the hydraulic pressure chamber, a directional control valve for selectively supplying the hydraulic pressure to the pressure chamber or draining the hydraulic pressure from the hydraulic pressure chamber depending on the engine operating conditions, and a hydraulic pressure passage that connects the pump with the hydraulic pressure chamber.

20. The valve operating device as claimed in claim 19, wherein an oil passage is formed in the main rocker shaft.

21. The valve operating device as claimed in claim 20, wherein the oil passage is formed independently of each rocker arm set.

22. The valve operating device as claimed in claim 21, wherein the low-speed rocker arm included in said one of the adjacent rocker arm sets has a first finger-shaped valve-stem-end contacting portion formed at a free end thereof with the first follower and bent from the first base portion of the low-speed rocker arm included in said one of the adjacent rocker arm sets toward a first one of the two adjacent valves respectively included in the associated cylinders adjoining each other, and the low-speed rocker arm included in the other of the adjacent rocker arm sets has a second finger-shaped valve-stem-end contacting portion formed at a free end thereof with the first follower and bent from the first base portion of the low-speed rocker arm included in the other of the adjacent rocker arm sets toward a second one of the two adjacent valves respectively included in the associated cylinders adjoining each other, and a direction bending the first finger-shaped valve-stem-end contacting portion and a direction bending the second finger-shaped valve-stem-end contacting portion are dimensioned so that the first finger-shaped valve-stem-end contacting portion and the second finger-shaped valve-stem-end contacting portion are spaced apart from each other.

23. The valve operating device as claimed in claim 22, wherein the second follower of the high-speed rocker arm included in said one of the adjacent rocker arm sets and the second follower of the high-speed rocker arm included in the other of the adjacent rocker arm sets are closely juxtaposed to each other and disposed between the first follower of the lower-speed rocker arm included in said one of the adjacent rocker arm sets and the first follower of the lower-speed rocker arm included in the other of the adjacent rocker arm sets.

24. The valve operating device as claimed in claim 23, wherein an end face of the high-speed rocker arm is provided with an inclined surface.

25. A valve operating device for an internal combustion engine, the valve operating device enabling both valve timing and valve-lift characteristic to be varied depending on engine operating conditions, comprising:

a camshaft adapted to be driven by a crankshaft;

at least two valves included in each engine cylinder, the valves opening and closing one of intake ports and outlet ports;

a cam pair provided for each valve, the cam pair including a low-speed cam and a high-speed cam, the cam pair being formed on said camshaft;

a main rocker shaft supported on a cylinder head, the main rocker shaft comprising a plurality of divided rocker shaft members supported on the cylinder head and including relatively short endmost rocker shaft members respectively located closer to both ends of the engine and relatively long intermediate divided rocker shaft members each being disposed between associated two cylinders adjoining to each other;

means for operating the valve provided for each individual valve, the means being supported by the main rocker shaft and arranged between two adjacent engine cylinders, the means operating the valve in accordance with a cam profile of the low-speed cam during a low-speed cam operating mode to provide a small valve lift and operating the valve in accordance with a cam profile of the high-speed cam during a high-speed cam operating mode to provide a large valve lift; and a mode switching device provided for the means, the mode switching device switching from one of the low-speed and high-speed cam operating modes to the other depending on the engine operating conditions.

26. A valve operating device for an internal combustion engine, the valve operating device enabling both valve timing and valve-lift characteristic to be varied depending on engine operating conditions, comprising:

a camshaft adapted to be driven by a crankshaft;

at least two valves included in each engine cylinder, the valves opening and closing one of intake ports and outlet ports;

a cam pair provided for each valve, the cam pair including a low-speed cam and a high-speed cam, the cam pair being formed on said camshaft;

a main rocker shaft supported on a cylinder head, the main rocker shaft comprising a plurality of divided rocker shaft members supported on the cylinder head and including relatively short endmost rocker shaft members respectively located closer to both ends of the engine and relatively long intermediate divided rocker shaft members each being disposed between associated two cylinders adjoining to each other;

a low-speed rocker arm having a first follower that is provided for each valve, the first follower being driven by the low-speed cam for operating the valve during a low-speed cam operating mode, the low-speed rocker arm being supported by the main rocker shaft;

a second follower provided for each valve and driven by the high-speed cam for operating the valve during a high-speed cam operating mode, the second follower being closely juxtaposed to the first follower and located within a dead space defined in an outside of the at least two valves included in each engine cylinder; and a mode switching device provided on the low-speed rocker arm for switching from one of the low-speed and high-speed cam operating modes to the other depending on the engine operating conditions, said mode switching device initiating the low-speed cam operating mode by disconnecting the first follower from the second follower, and initiating the high-speed cam operating mode by connecting the first follower to the second follower.

* * * * *